US011131064B2

(12) United States Patent
Sun et al.

(10) Patent No.: US 11,131,064 B2
(45) Date of Patent: Sep. 28, 2021

(54) ARAMID FIBER FAR-INFRARED EMITTING PAPER AND PREPARATION METHOD THEREOF

(71) Applicant: NANOCARBON CO., LTD., Jiangxi (CN)

(72) Inventors: Xiaogang Sun, Jiangxi (CN); Dianmo Zheng, Jiangxi (CN); Manyuan Cai, Jiangxi (CN); Yanyan Nie, Jiangxi (CN); Long Chen, Jiangxi (CN); Hezheng Pan, Jiangxi (CN)

(73) Assignee: NANOCARBON CO., LTD., Jiangxi (CN)

( * ) Notice: Subject to any disclaimer, the term of this patent is extended or adjusted under 35 U.S.C. 154(b) by 95 days.

(21) Appl. No.: 16/481,337

(22) PCT Filed: Aug. 22, 2018

(86) PCT No.: PCT/CN2018/101733

§ 371 (c)(1),
(2) Date: Jul. 26, 2019

(87) PCT Pub. No.: WO2020/037549

PCT Pub. Date: Feb. 27, 2020

(65) Prior Publication Data

US 2021/0010204 A1 Jan. 14, 2021

(51) Int. Cl.

| | |
|---|---|
| ***D21H 21/30*** | (2006.01) |
| ***D21D 1/02*** | (2006.01) |
| ***D21F 13/10*** | (2006.01) |
| ***D21H 13/26*** | (2006.01) |
| ***D21H 17/26*** | (2006.01) |
| ***D21H 17/37*** | (2006.01) |
| ***D21H 17/67*** | (2006.01) |
| ***D21H 17/00*** | (2006.01) |
| ***D21H 21/18*** | (2006.01) |
| ***D21H 23/04*** | (2006.01) |

(52) U.S. Cl.
CPC ..... *D21H 21/30* (2013.01); *D21D 1/02* (2013.01); *D21F 13/10* (2013.01); *D21H 13/26* (2013.01); *D21H 17/26* (2013.01); *D21H 17/375* (2013.01); *D21H 17/67* (2013.01); *D21H 17/74* (2013.01); *D21H 21/18* (2013.01); *D21H 23/04* (2013.01)

(58) Field of Classification Search
USPC ..... 162/146
See application file for complete search history.

(56) References Cited

FOREIGN PATENT DOCUMENTS

| | | | |
|---|---|---|---|
| CN | 102561109 | * | 7/2012 |
| CN | 102864676 | * | 1/2013 |
| CN | 108570882 | * | 9/2019 |

* cited by examiner

*Primary Examiner* — Mark Halpern
(74) *Attorney, Agent, or Firm* — Tutunjian & Bitetto, P.C.

(57) ABSTRACT

The present invention provides a preparation method of aramid fiber far-infrared emitting paper. In the present invention, para-aramid chopped fiber and para-aramid pulp fiber are used as paper base functional materials with excellent characteristics of high specific strength and high specific stiffness. In addition, the para-aramid chopped fiber and the para-aramid pulp fiber can form a paper material with pores and porous channels, and carbon nanotubes are embedded into the structural pores and porous channels of the paper material. Therefore, the aramid fiber far-infrared emitting paper has better molding quality and composite performance. Results of embodiments indicate that: A far-infrared wavelength emitted by the aramid fiber far-infrared emitting paper provided in the present invention is 4 μm to 20 μm, a main frequency band thereof is approximately 10 μm, and far-infrared conversion efficiency is up to 99%; and the aramid fiber far-infrared emitting paper has tensile strength of 0.12 $KN/mm^2$ to 0.18 $KN/mm^2$, and can be bent and folded.

18 Claims, No Drawings

ARAMID FIBER FAR-INFRARED EMITTING PAPER AND PREPARATION METHOD THEREOF

This application is a 371 of PCT/CN2018/101733 filed 22 Aug. 2018.

TECHNICAL FIELD

The present invention relates to the technical field of far-infrared emitting materials, and specifically, to aramid fiber far-infrared emitting paper and a preparation method thereof.

BACKGROUND

A far infrared ray is a light wave in an infrared wavelength range, and has a wavelength within a range of 3 μm to 100 μm, and therefore is often unperceived by a person. However, a far infrared ray has a very important effect on a life entity. After a human body absorbs far infrared rays, body temperature rises, blood capillary expands, and blood circulation is active, to enhance metabolism and operation of the human body. Excellent performance of a far infrared ray makes it more widely used in life sciences and biomedical fields. Currently, only a few devices can emit far infrared rays. However, due to a limitation on a nature of a material for emitting far infrared rays, far infrared rays emitted by these devices include a relatively large quantity of clutters, and therefore these devices have relatively low far infrared ray emissivity.

As a new material of a far infrared ray radiation source, carbon nanotubes have good physicochemical properties and can emit far infrared rays at a ratio up to above 90%, and therefore are an ideal material for emitting far infrared rays. Currently, application of carbon nanotubes in far infrared ray emission usually includes coating carbon nanotubes onto a finished film product (such as a plastic film). A formed carbon nanotube layer and the finished product film are only simply composited in a laminated manner, and a large relatively energy loss is generated in a position in which the two materials are composited. As a result, characteristics of the material itself cannot be fully exerted. Therefore, a composite material obtained by using this method has relatively low far infrared ray emissivity, so as to seriously restrict further application of the composite material.

SUMMARY

An objective of the present invention is to provide aramid fiber far-infrared emitting paper and a preparation method thereof. The aramid fiber far-infrared emitting paper obtained by using the preparation method provided in the present invention has excellent far-infrared emission performance and an excellent mechanical property.

To achieve the above purpose, the present invention provides the following technical solutions.

A preparation method of aramid fiber far-infrared emitting paper includes the following steps:

(1) mixing para-aramid chopped fiber with a disintegrating agent and water, conducting disintegration, cleaning obtained fiber, conducting low-temperature plasma surface treatment, mixing obtained fiber with a dispersant and water, and conducting ultrasonic treatment and pulping sequentially to obtain para-aramid chopped fiber pulp;

mixing para-aramid pulp fiber with the dispersant and water, and conducting ultrasonic treatment and pulping sequentially to obtain para-aramid pulp fiber pulp; and mixing the para-aramid chopped fiber pulp and the para-aramid pulp fiber pulp, and conducting shearing to obtain aramid fiber pulp;

(2) mixing carbon nanotubes with a dispersant and ethanol, and conducting ultrasonic treatment and shearing sequentially to obtain carbon nanotube dispersion liquid; and (3) mixing the aramid fiber pulp in step (1) with the carbon nanotube dispersion liquid in step (2) and a paper strength agent, conducting shearing, coating obtained mixed pulp onto a single surface of a substrate, conducting solidification and peeling the substrate, and conducting hot press molding on a solidified film to obtain the aramid fiber far-infrared emitting paper, where there is no limitation on a time sequence of step (1) and step (2).

Preferably, a mass ratio of the para-aramid chopped fiber and the para-aramid pulp fiber in step (1) and the carbon nanotubes in step (2) is (0.5-1.5):(0.5-1.5):(0.5-8).

Preferably, a length of the para-aramid chopped fiber in step (1) is 3 mm to 5 mm.

Preferably, a length of the para-aramid pulp fiber in step (1) is 1.2 mm to 1.8 mm.

Preferably, for surface treatment in step (1), pressure is 75 Pa to 85 Pa, power is 75 W to 85 W, and a time is 2.5 min to 3.5 min.

Preferably, the disintegrating agent in step (1) includes sodium dodecyl benzene sulfonate, polyvinylpyrrolidone, polyethylene oxide, or polyvinyl alcohol.

Preferably, the dispersant in step (1) includes polyoxyethylene.

Preferably, the dispersant agent in step (2) includes sodium dodecyl sulfate, polyvinylpyrrolidone, and sodium dodecyl benzene sulfonate.

Preferably, the carbon nanotubes in step (2) are whisker-like multiwalled carbon nanotubes.

Preferably, a length of the carbon nanotubes is 2 μm to 5 μm, and a diameter of the carbon nanotubes is 30 nm to 150 nm.

Preferably, the paper strength agent in step (3) includes anionic polyacrylamide or carboxymethylcellulose.

Preferably, a coating amount of the mixed pulp on the single surface of the substrate in step (3) is 0.2 $mL/cm^2$ to 2 $mL/cm^2$.

Preferably, in step (3), solidification temperature is 60° C. to 80° C., and solidification time is 22 h to 26 h.

Preferably, in step (3), temperature of hot press molding is 250° C. to 350° C., and linear pressure of hot press molding is 120 KN/m to 150 KN/m.

The invention further provides aramid fiber far-infrared emitting paper obtained by using the above preparation method with raw materials including the para-aramid chopped fiber, the para-aramid pulp fiber, and the carbon nanotubes, where the para-aramid chopped fiber and the para-aramid pulp fiber form a paper material with pores and porous channels, and the carbon nanotubes are embedded into the structural pores and porous channels of the paper material.

Preferably, a thickness of the aramid fiber far-infrared emitting paper is 0.25 mm to 0.35 mm.

The present invention provides a preparation method of aramid fiber far-infrared emitting paper, including mixing para-aramid chopped fiber with a disintegrating agent and water, conducting disintegration, cleaning obtained fiber, conducting low-temperature plasma surface treatment, mixing obtained fiber with a dispersant and water, and conducting ultrasonic treatment and pulping sequentially to obtain para-aramid chopped fiber pulp; mixing para-aramid pulp fiber with the dispersant and water, and conducting ultrasonic treatment and pulping sequentially to obtain para-aramid pulp fiber pulp; mixing carbon nanotubes with a dispersant and ethanol, and conducting ultrasonic treatment and shearing sequentially to obtain carbon nanotube dispersion liquid; mixing the aramid fiber pulp with the carbon nanotube dispersion liquid and a paper strength agent, conducting shearing, coating obtained mixed pulp onto a single surface of a substrate, conducting solidification and peeling the substrate, and conducting hot press molding on a solidified film, to obtain aramid fiber far-infrared emitting paper. In the present invention, the para-aramid chopped fiber and the para-aramid pulp fiber are used as paper base functional materials with excellent characteristics of high specific strength and high specific stiffness. In addition, the para-aramid chopped fiber and the para-aramid pulp fiber can form a paper material with pores and porous channels, and the carbon nanotubes are embedded into the structural pores and porous channels of the paper material. Therefore, the aramid fiber far-infrared emitting paper has better molding quality and composite performance, and can be used for heating cushions in a high-speed train, an airplane, a car, and the like. Results of embodiments indicate that: A far-infrared wavelength emitted by the aramid fiber far-infrared emitting paper provided in the present invention is 4 μm to 20 μm, a main frequency band thereof is approximately 10 μm, and far-infrared conversion efficiency is up to 99%; and the aramid fiber far-infrared emitting paper has tensile strength of 0.12 $KN/mm^2$ to 0.18 $KN/mm^2$, and can be bent and folded. This indicates that the aramid fiber far-infrared emitting paper provided in the present invention has excellent far-infrared emission performance and an excellent mechanical property.

In addition, the preparation method provided in the present invention has simple operation and is convenient for mass production.

DETAILED DESCRIPTION

The present invention provides a preparation method of aramid fiber far-infrared emitting paper, including the following steps:

(1) Mix para-aramid chopped fiber with a disintegrating agent and water, perform disintegration, clean obtained fiber, perform low-temperature plasma surface treatment, mix obtained fiber with a dispersant and water, and perform ultrasonic treatment and pulping sequentially to obtain para-aramid chopped fiber pulp;

mix para-aramid pulp fiber with the dispersant and water, and perform ultrasonic treatment and pulping sequentially to obtain para-aramid pulp fiber pulp; and mix the para-aramid chopped fiber pulp and the para-aramid pulp fiber pulp, and perform shearing to obtain aramid fiber pulp.

(2) Mix carbon nanotubes with a dispersant and ethanol, and perform ultrasonic treatment and shearing sequentially to obtain carbon nanotube dispersion liquid.

(3) Mix the aramid fiber pulp in step (1) with the carbon nanotube dispersion liquid in step (2) and a paper strength agent, perform shearing, coat obtained mixed pulp onto a single surface of a substrate, perform solidification and peel the substrate, and perform hot press molding on a solidified film to obtain the aramid fiber far-infrared emitting paper.

There is no limitation on a time sequence of step (1) and step (2).

In the present invention, the para-aramid chopped fiber is mixed with the disintegrating agent and water, disintegration is conducted, obtained fiber is cleaned, low-temperature plasma surface treatment is conducted, obtained fiber is mixed with the dispersant and water, and ultrasonic treatment and pulping are conducted sequentially to obtain the para-aramid chopped fiber pulp. In the present invention, a length of the para-aramid chopped fiber is preferably 3 mm to 5 mm. A source of the para-aramid chopped fiber is not particularly limited in the present invention, as long as the para-aramid chopped fiber used is a marketable commodity well known by a person skilled in the art.

The disintegrating agent is not particularly limited in the present invention, as long as the disintegrating agent used is a disintegrating agent well known by a person skilled in the art. In the present invention, the disintegrating agent preferably includes sodium dodecyl benzene sulfonate (SDBS), polyvinylpyrrolidone (PVP), polyethylene oxide (PEO), or polyvinyl alcohol (PVA), and is more preferably the sodium dodecyl benzene sulfonate. In the present invention, a mass ratio of the disintegrating agent, the para-aramid chopped fiber, and water is preferably (0.009-0.011):1:(50-150) and more preferably 0.01:1:100. Disintegration is not particularly limited in the present invention, as long as disintegration used is a disintegration technology solution well known by a person skilled in the art.

In the present invention, cleaning is preferably cleaning with water. A specific operation method of cleaning is not particularly limited in the present invention, as long as cleaning used is a cleaning technology solution well known by a person skilled in the art. In the present invention, cleaning is conducted to remove impurities on a surface of the para-aramid chopped fiber.

In the present invention, for surface treatment, pressure is preferably 75 Pa to 85 Pa and more preferably 80 Pa, power is preferably 75 W to 85 W and more preferably 80 W, and a time is preferably 2.5 min to 3.5 min and more preferably 3 min. In the present invention, low-temperature plasma surface treatment is conducted to further remove tiny impurities on the surface of the para-aramid chopped fiber.

The dispersant is not particularly limited in the present invention, as long as the dispersant used is a dispersant well known by a person skilled in the art. Specifically, the dispersant is polyoxyethylene. In the present invention, a mass ratio of the dispersant, the para-aramid chopped fiber, and water is preferably (0.009-0.011):1:(50-150) and more preferably 0.01:1:100. In the present invention, an ultrasonic treatment time is preferably 20 min to 30 min, and ultrasonic treatment power is not particularly limited in the present invention, as long as the ultrasonic treatment power used is power well known by a person skilled in the art. Pulping is not particularly limited in the present invention, as long as pulping used is a pulping technology solution well known by a person skilled in the art. In the present invention, a pulping time is preferably 5 min to 10 min, and pulp freeness in the pulping process is preferably 40° SR to 50° SR and more preferably 45° SR. In the present invention, the para-aramid chopped fiber is uniformly dispersed in water through ultrasonic treatment under an action of the dispersant, and further pulping is conducted, to obtain the para-aramid chopped fiber pulp.

In the present invention, the para-aramid pulp fiber is mixed with the dispersant and water, and ultrasonic treatment and pulping are sequentially conducted to obtain the para-aramid pulp fiber pulp. In the present invention, a length of the para-aramid pulp fiber is preferably 1.2 mm to 1.8 mm. A source of the para-aramid pulp fiber is not particularly limited in the present invention, as long as the para-aramid pulp fiber used is a marketable commodity well known by a person skilled in the art. The dispersant is not particularly limited in the present invention, as long as the dispersant used is a dispersant well known by a person skilled in the art. Specifically, the dispersant is polyoxyethylene. In the present invention, a mass ratio of the dispersant, the para-aramid pulp fiber, and water is preferably (0.009-0.011):1:(50-150) and more preferably 0.01:1:100. In the present invention, an ultrasonic treatment time is preferably 20 min to 30 min, and ultrasonic treatment power is not particularly limited in the present invention, as long as the ultrasonic treatment power used is power well known by a person skilled in the art. Pulping is not particularly limited in the present invention, as long as pulping used is a pulping technology solution well known by a person skilled in the art. In the present invention, a pulping time is preferably 5 min to 10 min, and pulp freeness in the pulping process is preferably 40° SR to 50° SR and more preferably 45° SR. In the present invention, the para-aramid pulp fiber is uniformly dispersed in water through ultrasonic treatment under an action of the dispersant, and further pulping is conducted, to obtain the para-aramid pulp fiber pulp.

In the present invention, after the para-aramid chopped fiber pulp and the para-aramid pulp fiber pulp are obtained, the para-aramid chopped fiber pulp and the para-aramid pulp fiber pulp are mixed and sheared to obtain the aramid fiber pulp. In the present invention, a rotation speed for shearing is preferably 1800 r/min to 2200 r/min and more preferably 2000 r/min, and a shearing time is preferably 30 min to 60 min and more preferably 40 min to 50 min.

In the present invention, the carbon nanotubes are mixed with the dispersant and the ethanol, and ultrasonic treatment and shearing are sequentially conducted to obtain the carbon nanotube dispersion liquid. In the present invention, the carbon nanotubes are preferably whisker-like multiwalled carbon nanotubes. In the present invention, a length of the carbon nanotubes is preferably 2 μm to 5 μm, and a diameter of the carbon nanotubes is preferably 30 nm to 150 nm. In the present invention, the carbon nanotubes are preferably prepared according to the method disclosed in the reference (Sun X G, Qiu Z W, Chen L, et al. Industrial synthesis of Whisker carbon nanotubes[C]//Materials Science Forum. Trans Tech Publications Ltd., 2016, 852:514), and carbon nanotubes prepared according to the method are linear high-purity high-crystallized carbon nanotubes. The dispersant is not particularly limited in the present invention, as long as the dispersant used is a dispersant well known by a person skilled in the art. In the present invention, the dispersant preferably includes sodium dodecyl sulfate (SDS), polyvinylpyrrolidone (PVP), and sodium dodecyl benzene sulfonate (SDBS). In the present invention, a mass ratio of the carbon nanotubes, the dispersant, and the ethanol is preferably 1:(0.05-0.1):(50-150). In the present invention, an ultrasonic treatment time is preferably 10 min to 30 min and more preferably 20 min, and ultrasonic treatment power is not particularly limited in the present invention, as long as the ultrasonic treatment power used is power well known by a person skilled in the art. In the present invention, a rotation speed for shearing is preferably 1800 r/min to 2200 r/min and more preferably 2000 r/min, and a shearing time is preferably 10 min to 30 min and more preferably 20 min. In the present invention, the carbon nanotubes are uniformly dispersed in the ethanol through ultrasonic treatment and shearing under an action of the dispersant.

In the present invention, after the aramid fiber pulp and the carbon nanotube dispersion liquid are obtained, the aramid fiber pulp is mixed with the carbon nanotube dispersion liquid and the paper strength agent, shearing is conducted, obtained mixed pulp is coated onto a single surface of a substrate and solidified, and the substrate is peeled, and hot press molding is conducted on an obtained solidified film, to obtain the aramid fiber far-infrared emitting paper. In the present invention, a mass ratio of the para-aramid chopped fiber, the para-aramid pulp fiber, and the carbon nanotubes is preferably (0.5-1.5):(0.5-1.5):(0.5-8), more preferably 1:1:(1-4), and most preferably 1:1:2. In the present invention, the paper strength agent preferably includes anionic polyacrylamide or carboxymethylcellulose. In the present invention, a weight of the paper strength agent is preferably 0.8% to 1.2% and more preferably 1% of a total weight of the para-aramid chopped fiber and the para-aramid pulp fiber. In the present invention, the aramid fiber pulp is preferably mixed with the carbon nanotube dispersion liquid and the paper strength agent in a stainless steel fluid mixer. In the present invention, a rotation speed for shearing is preferably 1800 r/min to 2200 r/min and more preferably 2000 r/min, and a shearing time is preferably 30 min to 60 min and more preferably 40 min to 50 min.

The substrate is not particularly limited in the present invention, as long as the substrate used is a substrate well known by a person skilled in the art. Specifically, the substrate is a cellulose substrate. A size of the substrate is not particularly limited in the present invention, as long as the size of the substrate is selected according to an actual requirement. In an embodiment of the present invention, the size of the substrate is specifically an A4 paper size, that is, 210 mm×297 mm. In the present invention, the substrate mainly acts as a base, can withstand pressure and high temperature, and is suitable for being peeled and separated.

Coating is not particularly limited in the present invention, as long as coating used is a coating technology solution well known by a person skilled in the art. In the present invention, slot-die coating is preferably used to uniformly coat the mixed pulp onto the single surface of the substrate. In the present invention, a coating amount of the mixed pulp on the single surface of the substrate is preferably 0.2 $mL/cm^2$ to 2 $mL/cm^2$ and more preferably 0.8 $mL/cm^2$ to 1.3 $mL/cm^2$.

In the present invention, solidification temperature is preferably 60° C. to 80° C., and solidification time is preferably 22 h to 26 h. In the present invention, through solidification, the mixed pulp coated on the single surface of the substrate can be preliminarily dried to form the solidified film on the single surface of the substrate, and the para-aramid chopped fiber and the para-aramid pulp fiber in the solidified film can form a grid structure, so that the carbon nanotubes are filled in the grid structure.

In the present invention, temperature of hot press molding is preferably 250° C. to 350° C., and linear pressure of hot press molding is preferably 120 KN/m to 150 KN/m. In the present invention, through hot press molding, the carbon nanotubes can be further pressed into a porous network formed by the aramid fiber pulp, so as to implement composition of the carbon nanotubes, the para-aramid chopped fiber, and the para-aramid pulp fiber.

The present invention provides aramid fiber far-infrared emitting paper obtained by using the preparation method in the foregoing technical solution. The aramid fiber far-infrared emitting paper is prepared by using raw materials including para-aramid chopped fiber, para-aramid pulp fiber, and carbon nanotubes, where the para-aramid chopped fiber and the para-aramid pulp fiber form a paper material with pores and porous channels, and the carbon nanotubes are embedded into the structural pores and porous channels of the paper material. In the present invention, a thickness of the aramid fiber far-infrared emitting paper is preferably 0.25 mm to 0.35 mm and more preferably 0.3 mm.

The following describes the technical solutions in the present invention clearly and completely with reference to embodiments of the present invention. Apparently, the described embodiments are merely a part rather than all of the embodiments of the present invention. All other embodiments obtained by a person of ordinary skill in the art based on the embodiments of the present invention without creative efforts shall fall within the protection scope of the present invention.

Embodiment 1

1 g para-aramid chopped fiber (a length is 3 mm to 5 mm) is mixed with 0.01 g sodium dodecyl benzene sulfonate and 100 mL water, disintegration is conducted, obtained fiber is cleaned, low-temperature plasma surface treatment is conducted for 3 min in conditions of pressure of 80 Pa and power of 80 W, obtained fiber is mixed with 0.01 g polyoxyethylene and 100 mL water, ultrasonic treatment is conducted for 20 min, and pulping is conducted for 10 min to control pulping freeness to be 40° SR, to obtain para-aramid chopped fiber pulp.

1 g para-aramid pulp fiber (a length is 1.2 mm to 1.8 mm) is mixed with 0.01 g polyoxyethylene and 100 mL water, ultrasonic treatment is conducted for 20 min, and pulping is conducted for 10 min to control pulping freeness to be 40° SR, to obtain para-aramid pulp fiber pulp.

The para-aramid chopped fiber pulp and the para-aramid pulp fiber pulp are mixed and sheared for 30 min at 2000 r/min to obtain aramid fiber pulp.

2 g whisker-like carbon nanotubes (a length is 2 μm to 5 μm and a diameter is 30 nm to 150 nm) is mixed with 0.1 g sodium dodecyl sulfate and 200 g ethanol and stirred, then ultrasonic treatment is conducted for 10 min, and finally shearing is conducted for 10 min at 2000 r/min to obtain carbon nanotube dispersion liquid.

The aramid fiber pulp, the carbon nanotube dispersion liquid, and anionic polyacrylamide (an adding amount is 1% of a total weight of the para-aramid chopped fiber and the para-aramid pulp fiber) are mixed in a stainless steel fluid mixer and sheared for 30 min at 2000 r/min, obtained mixed pulp is coated onto a single surface of a cellulose substrate (a size is 210 mm×297 mm) through slot-die coating, vacuum drying is conducted at 60° C. for 24 h, the cellulose substrate is peeled, and hot press molding is conducted on a solidified film by a roller-type hot press machine at 250° C. and linear pressure of 150 KN/m, to obtain aramid fiber far-infrared emitting paper with a thickness of 0.3 mm.

An optical grating and a detector are used to test far-infrared emission performance of the aramid fiber far-infrared emitting paper prepared in this embodiment, and a result indicates that: A far-infrared wavelength emitted by the aramid fiber far-infrared emitting paper is 4 μm to 20 μm, a main frequency band thereof is approximately 10 μm, and far-infrared conversion efficiency is up to 99%. This indicates that the aramid fiber far-infrared emitting paper provided in the present invention has good far-infrared emission performance.

A weight is hung below the aramid fiber far-infrared emitting paper prepared in this embodiment to test strength of the aramid fiber far-infrared emitting paper, and it is found from a result that the aramid fiber far-infrared emitting paper with a cross area of each square millimeter can withstand a 15 kg weight without being broken. In addition, the aramid fiber far-infrared emitting paper prepared in this embodiment can be bent randomly with an angle of bending of 0° to 180°. After the aramid fiber far-infrared emitting paper is folded in half, there is no obvious crease, and after the strength test, there is a relatively small difference between tensile strength at a crease and tensile strength at a part with no crease, the tensile strength at the crease is approximately 0.13 $KN/mm^2$, and the tensile strength at the part with no crease is 0.15 $KN/mm^2$. This indicates that the aramid fiber far-infrared emitting paper provided in the present invention has a good mechanical property.

Embodiment 2

2 g para-aramid chopped fiber (a length is 3 mm to 5 mm) is mixed with 0.02 g sodium dodecyl benzene sulfonate and 200 mL water, disintegration is conducted, obtained fiber is cleaned, low-temperature plasma surface treatment is conducted for 3 min in conditions of pressure of 80 Pa and power of 80 W, obtained fiber is mixed with 0.02 g polyoxyethylene and 200 mL water, ultrasonic treatment is conducted for 30 min, and pulping is conducted for 5 min to control pulping freeness to be 45° SR, to obtain para-aramid chopped fiber pulp.

2 g para-aramid pulp fiber (a length is 1.2 mm to 1.8 mm) is mixed with 0.01 g polyoxyethylene and 200 mL water, ultrasonic treatment is conducted for 30 min, and pulping is conducted for 5 min to control pulping freeness to be 45° SR, to obtain para-aramid pulp fiber pulp.

The para-aramid chopped fiber pulp and the para-aramid pulp fiber pulp are mixed and sheared for 60 min at 2000 r/min to obtain aramid fiber pulp.

2 g whisker-like carbon nanotubes (a length is 2 μm to 5 μm and a diameter is 30 nm to 150 nm) is mixed with 0.15 g sodium dodecyl sulfate and 150 g ethanol and stirred, then ultrasonic treatment is conducted for 20 min, and finally shearing is conducted for 20 min at 2000 r/min to obtain carbon nanotube dispersion liquid.

The aramid fiber pulp, the carbon nanotube dispersion liquid, and anionic polyacrylamide (an adding amount is 1% of a total weight of the para-aramid chopped fiber and the para-aramid pulp fiber) are mixed in a stainless steel fluid mixer and sheared for 60 min at 2000 r/min, obtained mixed pulp is coated onto a single surface of a cellulose substrate (a size is 210 mm×297 mm) through slot-die coating, vacuum drying is conducted at 80° C. for 24 h, the cellulose substrate is peeled, and hot press molding is conducted on a solidified film by a roller-type hot press machine at 350° C. and linear pressure of 120 KN/m, to obtain aramid fiber far-infrared emitting paper with a thickness of 0.3 mm.

An optical grating and a detector are used to test far-infrared emission performance of the aramid fiber far-infrared emitting paper prepared in this embodiment, and a result indicates that: A far-infrared wavelength emitted by the aramid fiber far-infrared emitting paper is 4 μm to 20 μm, a main frequency band thereof is approximately 10 μm, and far-infrared conversion efficiency is up to 99%. This indicates that the aramid fiber far-infrared emitting paper provided in the present invention has good far-infrared emission performance.

A weight is hung below the aramid fiber far-infrared emitting paper prepared in this embodiment to test strength of the aramid fiber far-infrared emitting paper, and it is found from a result that the aramid fiber far-infrared emitting paper with a cross area of each square millimeter can withstand a 17 kg weight without being broken. In addition, the aramid fiber far-infrared emitting paper prepared in this embodiment can be bent randomly with an angle of bending of 0° to 180°. After the aramid fiber far-infrared emitting paper is folded in half, there is no obvious crease, and after the strength test, there is a relatively small difference between tensile strength at a crease and tensile strength at a part with no crease, the tensile strength at the crease is approximately 0.16 $KN/mm^2$, and the tensile strength at the part with no crease is 0.17 $KN/mm^2$.

Embodiment 3

1 g para-aramid chopped fiber (a length is 3 mm to 5 mm) is mixed with 0.01 g sodium dodecyl benzene sulfonate and 100 mL water, disintegration is conducted, obtained fiber is cleaned, low-temperature plasma surface treatment is conducted for 3 min in conditions of pressure of 80 Pa and power of 80 W, obtained fiber is mixed with 0.01 g polyoxyethylene and 100 mL water, ultrasonic treatment is conducted for 30 min, and pulping is conducted for 10 min to control pulping freeness to be 50° SR, to obtain para-aramid chopped fiber pulp.

1 g para-aramid pulp fiber (a length is 1.2 mm to 1.8 mm) is mixed with 0.01 g sodium dodecyl sulfate and 100 mL water, ultrasonic treatment is conducted for 30 min, and pulping is conducted for 10 min to control pulping freeness to be 50° SR, to obtain para-aramid pulp fiber pulp.

The para-aramid chopped fiber pulp and the para-aramid pulp fiber pulp are mixed and sheared for 30 min at 2000 r/min to obtain aramid fiber pulp.

4 g whisker-like carbon nanotubes (a length is 2 μm to 5 μm and a diameter is 30 nm to 150 nm) is mixed with 0.2 g sodium dodecyl sulfate and 400 g ethanol and stirred, then ultrasonic treatment is conducted for 30 min, and finally shearing is conducted for 30 min at 2000 r/min to obtain carbon nanotube dispersion liquid.

The aramid fiber pulp, the carbon nanotube dispersion liquid, and anionic polyacrylamide (an adding amount is 1% of a total weight of the para-aramid chopped fiber and the para-aramid pulp fiber) are mixed in a stainless steel fluid mixer and sheared for 30 min at 2000 r/min, obtained mixed pulp is coated onto a single surface of a cellulose substrate (a size is 210 mm×297 mm) through slot-die coating, vacuum drying is conducted at 60° C. for 24 h, the cellulose substrate is peeled, and hot press molding is conducted on a solidified film by a roller-type hot press machine at 350° C. and linear pressure of 150 KN/m, to obtain aramid fiber far-infrared emitting paper with a thickness of 0.3 mm.

An optical grating and a detector are used to test far-infrared emission performance of the aramid fiber far-infrared emitting paper prepared in this embodiment, and a result indicates that: A far-infrared wavelength emitted by the aramid fiber far-infrared emitting paper is 4 μm to 20 μm, a main frequency band thereof is approximately 10 μm, and far-infrared conversion efficiency is up to 99%. This indicates that the aramid fiber far-infrared emitting paper provided in the present invention has good far-infrared emission performance.

A weight is hung below the aramid fiber far-infrared emitting paper prepared in this embodiment to test strength of the aramid fiber far-infrared emitting paper, and it is found from a result that the aramid fiber far-infrared emitting paper with a cross area of each square millimeter can withstand a 13 kg weight without being broken. In addition, the aramid fiber far-infrared emitting paper prepared in this embodiment can be bent randomly with an angle of bending of 0° to 180°. After the aramid fiber far-infrared emitting paper is folded in half, there is no obvious crease, and after the strength test, there is a relatively small difference between tensile strength at a crease and tensile strength at a part with no crease, the tensile strength at the crease is approximately 0.1 $KN/mm^2$, and the tensile strength at the part with no crease is 0.13 $KN/mm^2$.

The above description of the embodiment is only for helping to understand the method of the present invention and its core idea. It should be noted that, several improvements and modifications may be made by persons of ordinary skill in the art without departing from the principle of the present invention, and these improvements and modifications should also be considered within the protection scope of the present invention. Various modifications to these embodiments are readily apparent to persons skilled in the art, and the generic principles defined herein may be practiced in other embodiments without departing from the spirit or scope of the invention. Thus, the present invention is not limited to the embodiments shown herein but falls within the widest scope consistent with the principles and novel features disclosed herein.

What is claimed is:

1. A preparation method of aramid fiber far-infrared emitting paper, comprising the following steps:

(1) mixing para-aramid chopped fiber with a disintegrating agent and water, conducting disintegration, cleaning obtained fiber, conducting low-temperature plasma surface treatment, mixing obtained fiber with a dispersant and water, and conducting ultrasonic treatment and pulping sequentially to obtain para-aramid chopped fiber pulp;

mixing para-aramid pulp fiber with the dispersant and water, and conducting ultrasonic treatment and pulping sequentially to obtain para-aramid pulp fiber pulp; and mixing the para-aramid chopped fiber pulp and the para-aramid pulp fiber pulp, and conducting shearing to obtain aramid fiber pulp;

(2) mixing carbon nanotubes with a dispersant and ethanol, and conducting ultrasonic treatment and shearing sequentially to obtain carbon nanotube dispersion liquid; and (3) mixing the aramid fiber pulp in step (1) with the carbon nanotube dispersion liquid in step (2) and a paper strength agent, conducting shearing, coating obtained mixed pulp onto a single surface of a substrate, conducting solidification and peeling the substrate, and conducting hot press molding on a solidified film to obtain the aramid fiber far-infrared emitting paper, wherein there is no limitation on a time sequence of step (1) and step (2).

2. The preparation method according to claim 1, wherein a mass ratio of the para-aramid chopped fiber and the para-aramid pulp fiber in step (1) and the carbon nanotubes in step (2) is (0.5-1.5):(0.5-1.5):(0.5-8).

3. The preparation method according to claim 2, wherein a length of the para-aramid chopped fiber in step (1) is in a range of 3 mm to 5 mm.

4. The preparation method according to claim 2, wherein a length of the para-aramid pulp fiber in step (1) is in a range of 1.2 mm to 1.8 mm.

5. The preparation method according to claim 2, wherein the carbon nanotubes in step (2) are whisker-like multi-walled carbon nanotubes.

6. The preparation method according to claim 1, wherein a length of the para-aramid chopped fiber in step (1) is in a range of 3 mm to 5 mm.

7. The preparation method according to claim 1, wherein a length of the para-aramid pulp fiber in step (1) is in a range of 1.2 mm to 1.8 mm.

8. The preparation method according to claim 1, wherein for surface treatment in step (1), pressure is in a range of 75 Pa to 85 Pa, power is in a range of 75 W to 85 W, and a time is in a range of 2.5 min to 3.5 min.

9. The preparation method according to claim 1, wherein the disintegrating agent in step (1) comprises sodium dodecyl benzene sulfonate, polyvinylpyrrolidone, polyethylene oxide, or polyvinyl alcohol.

10. The preparation method according to claim 1, wherein the dispersant in step (1) comprises polyoxyethylene.

11. The preparation method according to claim 1, wherein the dispersant agent in step (2) comprises sodium dodecyl sulfate, polyvinylpyrrolidone, and sodium dodecyl benzene sulfonate.

12. The preparation method according to claim 1, wherein the carbon nanotubes in step (2) are whisker-like multi-walled carbon nanotubes.

13. The preparation method according to claim 12, wherein a length of the carbon nanotubes is in a range of 2 μm to 5 μm, and a diameter of the carbon nanotubes is in a range of 30 nm to 150 nm.

14. The preparation method according to claim 1, wherein the paper strength agent in step (3) comprises anionic polyacrylamide or carboxymethylcellulose.

15. The preparation method according to claim 1, wherein a coating amount of the mixed pulp on the single surface of the substrate in step (3) is in a range of 0.2 $mL/cm^2$ to 2 $mL/cm^2$.

16. The preparation method according to claim 15, wherein a length of the carbon nanotubes is in a range of 2 μm to 5 μm, and a diameter of the carbon nanotubes is in a range of 30 nm to 150 nm.

17. The preparation method according to claim 1, wherein in step (3), solidification temperature is in a range of 60° C. to 80° C., and solidification time is in a range of 22 h to 26 h.

18. The preparation method according to claim 1, wherein in step (3), temperature of hot press molding is in a range of 250° C. to 350° C., and linear pressure of hot press molding is in a range of 120 KN/m to 150 KN/m.

* * * * *